United States Patent [19]

Katsumata et al.

[11] Patent Number: 5,043,190

[45] Date of Patent: Aug. 27, 1991

[54] PROCESS FOR PRODUCING CAST-COATED PAPERS

[75] Inventors: Hitoshi Katsumata; Tetsuya Matsumoto; Hirosi Aizawa; Taiji Nakajima; Kouichi Nagai, all of Ibaraki, Japan

[73] Assignee: Nippon Kakoh Saishi K.K., Tokyo, Japan

[21] Appl. No.: 513,797

[22] Filed: Apr. 24, 1990

[30] Foreign Application Priority Data

May 2, 1989 [JP] Japan ..... 1-112038

[51] Int. Cl.[5] ..... B05D 3/12

[52] U.S. Cl. ..... 427/362; 427/342; 427/366; 427/370; 427/391; 427/395; 162/136

[58] Field of Search ..... 427/342, 362, 366, 370, 427/391, 395, 411; 162/136, 135; 428/342, 511, 537.5

[56] References Cited

U.S. PATENT DOCUMENTS

| | | | |
|---|---|---|---|
| 4,048,380 | 9/1977 | Blakey et al. | 428/511 |
| 4,265,969 | 5/1981 | Yasuda et al. | 428/342 |
| 4,515,833 | 5/1985 | Nojima et al. | 427/362 |
| 4,581,257 | 4/1986 | Kondo et al. | 427/336 |
| 4,620,992 | 11/1986 | Nojima et al. | 427/362 |
| 4,686,119 | 8/1987 | Nojima et al. | 427/362 |
| 4,900,583 | 2/1990 | Hirabayashi et al. | 427/55 |
| 4,975,473 | 12/1990 | Kaneda et al. | 523/221 |

*Primary Examiner*—Shrive Beck
*Assistant Examiner*—Terry J. Owens
*Attorney, Agent, or Firm*—Wolf, Greenfield & Sacks

[57] ABSTRACT

Cast-coated papers having high surface gloss, smoothness and high surface strength are produced by applying an aqueous pigment coating onto the surface of a base paper, drying the applied pigment coating to form a cast-coated layer, rewetting the pigment coating layer with a rewetting solution, pressing the rewetted pigment coating layer into contact with a heated, highly polished drum to impart a high gloss surface, the rewetting solution containing a dispersant and/or a release agent as its main components and having its pH adjusted to be between 2 and 4 by incorporation of at least one carboxylic acid selected from the group consisting of formic acid, acetic acid, tartatic acid, citric acid, lactic acid, succinic acid, malic acid and benzoic acid.

9 Claims, No Drawings

PROCESS FOR PRODUCING CAST-COATED PAPERS

BACKGROUND OF THE INVENTION

1. Field of the Invention

The present invention relates to a cast-coated paper. More particularly, the present invention relates to a process for producing cast-coated papers that have improved gloss characteristics not only before printing but also after printing, that have high surface strength, and that are free from surface imperfections such as pinholes and uneven adhesion between the base paper and the cast-coated layer.

2. Description of the Prior Art

Because of advantages such as high surface gloss and smoothness, cast-coated papers enable highly reliable so they are suitable for precise and high-grade printing operations and are extensively used in artistic printed matter, high-quality catalogs, the front covers of magazines, labels, wrapping papers, etc.

Cast-coated papers are conventionally produced by a process that comprises applying an aqueous pigment coating (i.e., a composition that contains a pigments and an adhesive as its main components) onto the surface of a base paper to form a pigment coating layer, which is is then pressed and dried in contact with a heated, highly polished metal drum. While this process is practiced in several ways, they can be roughly divided into three types, a wet (direct) method, a gelation (coagulation) method and a rewet (indirect) method in accordance with the manner in which the pigment coating layer is pressed and dried in contact with the heated, highly polished metal drum to get the cast-coated paper with a glossy surface. In the wet method, the pigment coating layer is pressed and dried in contact with the heated metal drum while it is still in a wet and plasticized state. In the gelation method, the pigment coating layer is passed through a coagulating bath so that it gels and becomes plasticized before it is pressed and dried in contact with the heated metal drum. In the rewet method, the pigment coating layer is first dried, then optionally supercalendered, and thereafter rewetted with a wetting solution to be rendered plasticized so that it can be pressed and dried in contact with the heated metal drum to give a glossy surface.

The three basic processes for producing cast-coated papers share the common feature that the pigment coating layer, while it is in a plasticized state, is pressed and dried in contact with a heated, highly polished drum. Hence, the water in the pigment coating layer partly evaporates through the base paper and partly through the pigment coating layer toward the drum surface. If the rate of water evaporation exceeds a certain level, pinholes will develop in the surface of the cast-coated layer and the resulting cast-coated paper is no longer suitable for use in printed matter. In other words, the rate of production of cast-coated papers is reduced. This phenomenon is particularly noticeable in the wet process which involves fairly extensive water evaporation, so that wet method has been increasingly supplanted by the rewet process in commercial operations for high-speed production of cast-coated papers.

The rewet process, however, has the disadvantage that the pigment coating layer is not as highly plasticized as in the wet and gelation processes. Hence, the recipe of aqueous pigment coatings for providing cast-coated layers, the selection of a rewetting solution, and the selection of operating conditions such as the working speed, the temperature of a highly polished drum and the pressure at which the pigment coating layer is brought into contact with the drum are important in the practice of the rewet method and if these factors are not properly selected, the surface of the cast-coated layer will develop various imperfections such as pinholes and uneven adhesion to the base paper.

The gelation process in which the pigment coating layer is made to gel by treatment in a coagulating bath enables casting operations to be carried out at fairly high temperatures. On the other hand, the gelation process usually involves no drying step, so the drying load on the surface of the casting drum is higher than in the rewet process. Further, the coagulation step which is performed just prior to the casting operation is incapable of providing satisfactory gelation, and the coagulant used has the potential to reduce the strength and gloss of the cast-coated paper.

SUMMARY OF THE INVENTION

It is therefore an object of the present invention to provide a process for producing cast-coated papers that improved gloss characteristics not only before printing but also after printing, that have high surface strength, and that are free from surface imperfections such as pinholes and uneven adhesion between the base paper and the cast-coated layer.

Another object of the present invention is to provide cast-coated papers enable highly reliable because of advantages such as high surface gloss and smoothness, so they are suitable for precise and high-grade printing operations and are extensively used in artistic printed matter, high-quality catalogs, the front covers of magazines, labels, wrapping papers, etc.

Other objects and advantages of the present invention may become apparent to those skilled in the art from the following description.

DETAILED DECRIPTION OF THE PREFERRED EMBODIMENTS

The present invention relates to an improvement of a rewet process for producing a cast-coated paper which comprises applying an aqueous pigment coating onto the surface of a base paper, drying the applied pigment coating to form a cast-coated layer, rewetting the pigment coating layer with a rewetting solution, pressing the rewetted pigment coating layer in contact with a heated, highly polished drum, and drying said pigment coating layer in contact with the drum to give a high gloss surface. The improvement comprises incorporating a dispersant and/or a release agent as main components into said rewetting solution and having its pH adjusted to be between 2 and 4 by the incorporation of at least one carboxylic acid selected from the group consisting of formic acid, acetic acid, tartaric acid, citric acid, lactic acid, succinic acid, malic acid and benzoic acid.

While there are several reasons for which pinholes and other surface imperfections occur in cast-coated paper, it is known that rapid evaporation of water will destroy the cast-coated layer to cause pinholes and blisters. With a view to avoiding these problems, the air permeability of base paper is enhanced or the air permeability of the cast-coated layer is improved by modifying the proportions of pigments, and latices. However, the degree of these improvements is limited and a substantial change in the constitution of aqueous pigment coatings can often cause adverse effects on such factors as the viscosity of the pigment coatings and the quality of cast-coated paper, and no completely satisfactory results have yet been attained.

The present inventors conducted intensive studies on a rewet process by which cast-coated papers particularly having high quality, and an absence of pinholes cold be produced in high yield. As a result, the present inventors found that their objective could be attained by using a rewetting solution that contains a dispersant and/or a release agent as the main components and which has its pH adjusted to be between 2 and 4 by incorporation of a selected carboxylic acid.

The carboxylic acid used in the present invention would perform the following functions: when the pigment coating layer is swelled to plasticize on account of the water, dispersant, release agent and other components of the rewetting solution, the carboxylic acid acts as a coagulant and its coagulating action is enhanced to insure a definite result by subsequent heating and drying in contact with the highly polished drum. In the conventional gelation method, carboxylic acids are used as the principal or sole component of the rewetting agent but the process of the present invention is characterized in that the intended object can be attained under mild conditions by using a rewetting agent that contains a dispersant and/or a release agents as main components and which additionally incorporates a small amount of a selected carboxylic acid. Compared to the ordinary rewet process which does not use a carboxylic acid in the rewetting solution, the process of the present invention has the advantage that cast-coated papers having less pinholes can be produced at an increased casting speed. Further, the suitable degree of coagulation provided by the carboxylic acid insures the production of cast-coated papers that have improved gloss not only before printing but also after printing and that also have high surface strength.

The carboxylic acid that may be used in the present invention is such that it is capable of attaining the intended object by a mild action and it is selected from the group consisting of formic acid, acetic acid, tartaric acid, citric acid, lactic acid, succinic acid, malic acid and benzoic acid. At least one of these carboxylic acids are incorporated into the rewetting solution to adjust its pH to be between 2 and 4. An optimal ph is about 3 from the viewpoint of the gloss of cast-coated papers both before and after printing, their surface strength and quality (e.g. absence of pinholes). If the pH of the rewetting solution is less than 2, its coagulating action is excessive. Further, the cast-coated layer may be destroyed if calcium carbonate or other pigments that are highly reactive are present in it. If the pH of the rewetting solution is more than 4, its coagulating action is insufficient to attain the intended object.

A phosphate such as sodium tripolyphosphate, sodium pyrophosphate or sodium hexametaphosphate is used as a dispersant in the rewetting solution. The release agent to be contained in the rewetting solution is selected from among metal salts of aliphatic acids such as ammonium stearate, calcium stearate and zinc stearate, and from polyethylene emulsions and microcrystalline wax.

The process of the present invention for producing a cast-coated paper that has improved gloss both before and after printing, that has high surface strength and that is free from surface imperfections such as pinholes and uneven adhesion between the cast-coated layer and the base paper is described below in detail. The aqueous pigment coating that is used in providing a cast-coated layer on the surface of a base paper may be of any type commonly used in the art and it contains a pigment and an adhesive as its main components together with suitable additives that are selected from among release agents, colorants, defoamers, viscosity modifiers, waterproofing agents, etc. in accordance with the specific object of use.

Suitable pigments include clays, kaolin, aluminum hydroxide, calcium carbonate, titanium oxide, barium sulfate, satin white and various plastic pigments. Suitable adhesives include synthetic resin latices such as styrene-butadiene latex, methyl methacrylate-butadiene latex and styrene-vinyl acetate latex, as well as water-soluble adhesives such as casein, soybean protein, oxidized starches, modified starches and polyvinyl alcohol. These adhesives are incorporated in amounts ranging from 15 to 35 parts by weight per 100 parts by weight of the pigment. Besides the pigment and adhesive, additives such as release agents, colorants, defoamers, viscosity modifiers and water-proofing agents may be incorporated in the aqueous pigment coating.

The aqueous pigment coating that contains a pigment and an adhesive as main components and which optionally contains suitable additives to a solids content of 40–70% is applied onto the surface of a base paper (basis weight, 40–350 g/m$^2$) to give a coating weight of 5–30 g/m$^2$ with a suitable apparatus such as an air-knife coater, a blade coater, a roll coater or a rod coater. The applied pigment coating is dried with hot air at 120°–180° C. to provide a pigment coating layer.

The pigment coating layer thus provided on the base paper is smoothed by supercalendering, gloss calendering or some other suitable means. Thereafter, the pigment coating layer is rewetted with the rewetting solution conditioned in accordance with the present invention, whereby, the pigment coating layer is rendered plasticized. The plasticized layer is pressed and dried in contact with a highly polished drum heated at 100°–120°C., whereby a cast-coated paper that retains a highly glossy and storing surface and that is free from surface imperfections such as pinholes and uneven adhesion can be produced at high speed.

EXAMPLES

The following examples are provided for the purpose of further illustrating the present invention but are in no way to be taken as limiting.

EXAMPLE 1

| Recipe I for cast-coated layer | Parts by weight |
|---|---|
| Kaolin | 70 |
| Precipitated calcium carbonate | 30 |
| Sodium polyacrylate | 0.7 |
| Casein | 7 |
| Styrene-butadiene latex | 19 |
| Zinc chloride | 1 |
| Ammonium stearate | 0.5 |
| **Recipe II rewetting solution** | **Parts by weight** |
| Water | 100 |
| Sodium hexametaphosphate | 0.5 |
| Ammonium stearate | 0.2 |
| Formic acid | 0.3 |

An aqueous pigment coating (solids cont. 47%) was prepared from the recipe I and applied onto the surface of a base paper (basis weight =100 g/m$^2$) to give a caoting weight in a dry weight of 22 g/m$^2$. The applied pigment coating was dried to a water content of 6%, whereby a pigment coating layer was formed. Subsequently, the surface of the pigment coating layer was treated with a rewetting solution of the recipe II that was adjusted to a pH of 3. Immediately after the rewetting treatment, the rewetted pigment coating layer was pressed and dried in contact with a heat (110° C.) casting drum to produce a cast-coated paper.

EXAMPLE 2

A cast-coated paper was produced by repeating the procedure of Example 1 except that the pH of the rewetting solution was adjusted to 2 with formic acid.

EXAMPLE 3

A cast-coated paper was produced by repeating the procedure of Example 1 except that the pH of the rewetting solution was adjusted to 4 with formic acid.

EXAMPLE 4

A cast-coated paper was produced by repeating the procedure of Example 1 except that a rewetting solution having a pH of 3 prepared from the recipe III shown below.

| Recipe III of rewetting solution | Parts by weight |
|---|---|
| Water | 100 |
| Sodium hexametaphosphate | 0.5 |
| Calcium stearate | 0.2 |
| Acetic acid | 0.4 |

EXAMPLE 5

| Recipe IV of rewetting solution | Parts by weight |
|---|---|
| Water | 100 |
| Sodium hexametaphosphate | 0.5 |
| Calcium stearate | 0.2 |
| Citric acid | 0.4 |

A cast-coated paper was produced by repeating the procedure of Example 1 except that a rewetting solution having a pH of 3 was prepared from the recipe IV shown above.

EXAMPLE 6

| Recipe V of rewetting solution | Parts by weight |
|---|---|
| Water | 100 |
| Sodium pyrophosphate | 0.5 |
| Polyethylene emulsion | 0.25 |
| Tartaric acid | 0.4 |

A cast-coated paper was produced by repeating the procedure of Example 1 except that a rewetting solution having a pH of 3 was prepared from the recipe V shown above.

EXAMPLE 7

| Recipe VI of rewetting solution | Parts by weight |
|---|---|
| Water | 100 |

-continued

| Recipe VI of rewetting solution | Parts by weight |
|---|---|
| Sodium tripolyphosphate | 0.5 |
| Formic acid | 0.3 |

A cast-coated paper was produced by repeating the procedure of Example 1 except that a rewetting solution having a pH of 3 was prepared from the recipe VI shown above.

EXAMPLE 8

| Recipe VII of rewetting solution | Parts by weight |
|---|---|
| Water | 100 |
| Calcium stearate | 0.5 |
| Acetic acid | 0.4 |

A cast-coated paper was produced by repeating the procedure of Example 1 except that a rewetting solution having a pH of 3 was prepared from the recipe VII shown above.

COMPARATIVE EXAMPLE 1

| Recipe VIII of rewetting solution | Parts by weight |
|---|---|
| Water | 100 |
| Sodium tripolyphosphate | 0.5 |
| Calcium stearate | 0.2 |
| Formic acid | 1.2 |

A comparative cast-coated paper was produced by repeating the procedure of Example 1 except that a rewetting solution having a pH of 1 was prepared from the recipe VIII shown above.

COMPARATIVE EXAMPLE 2

| Recipe IX of rewetting solution | Parts by weight |
|---|---|
| Water | 100 |
| Sodium hexametaphosphate | 0.5 |
| Ammonium stearate | 0.2 |
| Formic acid | 0.18 |

A comparative cast-coated paper was produced by repeating the procedure of Example 1 except that a rewetting solution having a pH of a 5 was prepared from the recipe IX shown above.

COMPARATIVE EXAMPLE 3

| Recipe X of rewetting solution | Parts by weight |
|---|---|
| Water | 100 |
| Sodium hexametaphosphate | 0.5 |
| Ammonium stearate | 0.2 |

A comparative cast-coated paper was produced by repeating the procedure of Example 1 except that a rewetting solution was prepared from the recipe X shown above.

COMPARATIVE EXAMPLE 4

| Recipe XI of rewetting solution | Parts by weight |
|---|---|
| Water | 100 |
| Sodium pyrophosphate | 0.5 |

-continued

| Recipe XI of rewetting solution | Parts by weight |
|---|---|
| Calcium stearate | 0.2 |

A comparative cast-coated paper was produced by repeating the procedure of Example 1 except that a rewetting solution was prepared from the recipe XI shown above.

COMPARATIVE EXAMPLE 5

| Recipe XII of rewetting solution | Parts by weight |
|---|---|
| Water | 100 |
| Sodium hexametaphosphate | 0.5 |
| Polyethylene emulsion | 0.25 |

A comparative cast-coated paper was produced by repeating the procedure of Example 1 except that a rewetting solution was prepared from the recipe XII shown above.

The cast-coated papers prepared in Examples 1–6 and Comparative Examples 1–5 were tested for their quality. The results of the quality tests are shown in the following table, from which one can see that the cast-coated papers produced in accordance with the present invention had a satisfactory surface gloss and surface hardness both before and after printing. In addition, the occurrence of pinholes in these samples was negligible.

CRITERIA FOR THE EVALUATION OF PINHOLE FORMATION

◎: the formation of pinholes was negligible and the result was very satisfactory ○: the formation of pinholes was slight and caused no troubles in use Δ: the formation of pinholes was substantial and rendered the sample unsuitable for use ×: the formation of pinholes was extensive and rendered the sample unsuitable for use

CRITERIA FOR THE EVALUATION OF SURFACE STRENGTH

◎: no pick and very satisfactory

○: very few picks and satisfactory

○: many picks and unsuitable for use

×: so many picks occurred that the sample was unsuitable for use

| | Results of Quality Tests | | | |
|---|---|---|---|---|
| | | Gloss (%) | | Surface |
| | Pinhole | before printing | after printing | strength (IR tester) |
| Example | | | | |
| 1 | ◎ | 93 | 98 | ◎ |
| 2 | ◎ | 92 | 96 | ◎ |
| 3 | ◎ | 92 | 98 | ◎ |
| 4 | ◎ | 92 | 97 | ◎ |
| 5 | ◎ | 92 | 97 | ◎ |
| 6 | ◎ | 92 | 98 | ◎ |
| 7 | ◎ | 92 | 97 | ◎ |
| 8 | ◎ | 92 | 96 | ◎ |
| Comparative Example | | | | |
| 1 | Δ | 88 | 91 | ○ |
| 2 | Δ | 86 | 90 | ○ |
| 3 | X | 81 | 86 | X |
| 4 | X | 82 | 86 | Δ |
| 5 | X | 81 | 85 | X |

Gloss before printing: measured in accordance with JIS P 8142
Gloss after printing: measured in accordance with JIS P 8142

As described on the foregoing pages, the rewet process of the present invention has the advantage that it is a capable of efficient production of cast-coated papers that retain their characteristic high surface gloss and other properties and which are yet free from surface imperfections such as pinholes and uneven adhesion between the cast-coated layer and the base paper. Hence, the present invention is expected to offer great benefits to the industry.

What is claimed is:

1. In a process for producing cast-coated paper which comprises applying an aqueous pigment coating onto the surface of a base paper, drying the applied pigment coating to form a pigment coating layer, rewetting the pigment coating layer with a rewetting solution, pressing the rewetted pigment coating layer into contact with a heated, highly polished drum, and drying said rewetted pigment coating layer in contact with the drum to impart a high gloss surface, the improvement wherein said rewetting solution contains a dispersant and a release agent as its main components and has its pH adjusted to be between 2 and 4 by incorporation of at least one carboxylic acid selected from the group consisting of formic acid, acetic acid, tartaric acid, citric acid, lactic acid, succinic acid, malic acid and benzoic acid.

2. A process according to claim 1 wherein said carboxylic acid is selected from the group consisting of formic acid, acetic acid, tartaric acid and citric acid.

3. A process according to claim 1 wherein said pH of the rewetting solution is adjusted to about 3.

4. In a process for producing cast-coated paper which comprises applying an aqueous pigment coating onto the surface of a base paper, drying the applied pigment coating to form a pigment coating layer, rewetting the pigment coating layer with a rewetting solution, pressing the rewetted pigment coating layer into contact with a heated, highly polished drum, and drying said rewetted pigment coating layer in contact with the drum to impart a high gloss surface, the improvement wherein said rewetting solution contains a dispersant and has its pH adjusted to be between 2 and 4 by incorporation of at least one carboxylic acid selected from the group consisting of formic acid, acetic acid, tartaric acid, citric acid, lactic acid, succinic acid, malic acid and benzoic acid.

5. A process according to claim 4 wherein said carboxylic acid is selected from the group consisting of formic acid, acetic acid, tartaric acid and citric acid.

6. A process according to claim 4 wherein said pH of the rewetting solution is adjusted to about 3.

7. In a process for producing cast-coated paper which comprises applying an aqueous pigment coating onto the surface of a base paper, drying the applied pigment coating to form a pigment coating layer, rewetting the pigment coating layer with a rewetting solution, pressing the rewetted pigment coating layer into contact with a heated, highly polished drum, and drying said rewetted pigment coating layer in contact with the drum to impart a high gloss surface, the improvement wherein said rewetting solution contains a releasing agent and has its pH adjusted to be between 2 and 4 by incorporation of at least one carboxylic acid selected from the group consisting of formic acid, acetic acid, tartaric acid, citric acid, lactic acid, succinic acid, malic acid and benzoic acid.

8. A process according to claim 7 wherein said carboxylic acid is selected from the group consisting of formic acid, acetic acid, tartaric acid and citric acid.

9. A process according to claim 7 wherein said pH of the rewetting solution is adjusted to about 3.

* * * * *